US007743941B2

(12) United States Patent
Arnoldo et al.

(10) Patent No.: US 7,743,941 B2
(45) Date of Patent: Jun. 29, 2010

(54) LID OPENING MECHANISM

(75) Inventors: Sven Arnoldo, Malsch (DE); Burkhard Jägersküpper, Karlsruhe (DE); Nelly César, Karlsruhe (DE)

(73) Assignee: Faurecia Innenraum Systeme GmbH, Hagenbach (DE)

( * ) Notice: Subject to any disclaimer, the term of this patent is extended or adjusted under 35 U.S.C. 154(b) by 99 days.

(21) Appl. No.: 11/664,168

(22) PCT Filed: Oct. 2, 2005

(86) PCT No.: PCT/DE2005/001769

§ 371 (c)(1),
(2), (4) Date: Aug. 21, 2007

(87) PCT Pub. No.: WO2006/037308

PCT Pub. Date: Apr. 13, 2006

(65) Prior Publication Data

US 2008/0016775 A1 Jan. 24, 2008

(30) Foreign Application Priority Data

Oct. 5, 2004 (DE) ..... 10 2004 048 457
Oct. 5, 2004 (DE) ..... 10 2004 048 470

(51) Int. Cl.
*B65D 43/16* (2006.01)
*B65D 43/22* (2006.01)

(52) U.S. Cl. ..... 220/817; 220/827; 220/835

(58) Field of Classification Search ..... 220/817, 220/827, 835, 244
See application file for complete search history.

(56) References Cited

U.S. PATENT DOCUMENTS 1,774,199 A * 8/1930 Good ..... 296/76
2,736,455 A * 2/1956 Rosen ..... 220/521
3,048,899 A * 8/1962 Vincent et al. ..... 49/152
3,403,473 A 10/1968 Agustin
4,811,518 A * 3/1989 Ladisa ..... 49/193
5,067,625 A * 11/1991 Numata ..... 220/827
5,195,272 A * 3/1993 Yamada ..... 49/193
5,357,652 A * 10/1994 Yamada ..... 16/232
5,367,828 A * 11/1994 Hashemnia ..... 49/382

(Continued)

FOREIGN PATENT DOCUMENTS

DE 101 51 704 A1 5/2003

(Continued)

*Primary Examiner*—Anthony Stashick
*Assistant Examiner*—Niki M Eloshway
(74) *Attorney, Agent, or Firm*—Arent Fox LLP

(57) ABSTRACT

The Invention relates to a lid opening mechanism (A), for opening a lid element (1) on a fist side (Y1) about a first lid rotational axis (21), or optionally on a second side (Y2) about a second lid rotational axis (22), whereby the first rotational axis (21) and the second rotational axis (22) are each formed from a front (21*a*) or (21*b*) and a rear (22*a* or 22*b*) rotational axis element. The operating devices (B1, B2) are connected to and cooperate after a fashion with a rotational axis control device (M), with a control element (150) and with operating bars (161, 162) which cooperate with the operating devices (B1, B2), such that on operating one of the operating elements (110 or 120) for activation of the first or second rotational axis (21 or 22) a control element (150) locks the other operating element (120 or 110) respectively.

6 Claims, 8 Drawing Sheets

U.S. PATENT DOCUMENTS

| | | | | |
|---|---|---|---|---|
| 5,647,652 | A * | 7/1997 | Zalewski et al. | 312/324 |
| 5,931,336 | A | 8/1999 | Takeuchi | |
| 5,983,453 | A * | 11/1999 | Miwa | 16/231 |
| 6,142,333 | A * | 11/2000 | Sasamoto et al. | 220/264 |
| 6,688,657 | B2 * | 2/2004 | Peacock et al. | 292/35 |

FOREIGN PATENT DOCUMENTS

| | | | |
|---|---|---|---|
| DE | 101 64 340 | C1 | 10/2003 |
| DE | 102 47 453 | A1 | 4/2004 |
| EP | 0 494 496 | B1 | 7/1992 |
| EP | 0 562 244 | B1 | 9/1993 |
| JP | 03-189249 | A | 1/1993 |

* cited by examiner

LID OPENING MECHANISM

CROSS-REFERENCE TO RELATED APPLICATION

This application is a National Stage entry of International Application No. PCT/DE2005/001769, filed Oct. 5, 2005, the entire specification claims and drawings of which are incorporated herewith by reference.

The invention relates to a lid opening mechanism, in particular for use for a central console of a motor vehicle.

EP 0 494 496 B1 discloses a releasable double hinge means for a console box.

EP 0 562 244 B1 discloses a lid opening and closing device which is shaped such that a lid body of a crate body can be opened and closed from either side, the right or the left.

JP 03 127 826 discloses an opening mechanism by means of which a lid can be opened to two sides. Here, the rotational axes are each divided in two. To open the lid on one side, the rotational axis parts of the respectively other side are pressed apart in the shape of a wedge so that the ends of the rotational axis parts enter corresponding receivers in the container and form an effective rotational axis.

DE 101 51 704 C2 discloses an opening mechanism for opening a lid to two sides, in which the rotational axes are each divided into two. The rotational axes are moved apart or together by the fact that an actuating element which runs transversely in relation thereto and is also divided into two has at its ends guide tracks in which projections from respective mutually facing ends of the rotational axis parts are guided such that the rotational axis parts of the one side are moved apart when the rotational axis parts of the other side are moved together. The two parts of the actuating element are pretensioned into a position in which they are moved apart by means of a spring.

A mechanism which acts in a similar way is disclosed in U.S. Pat. No. 5,931,336.

The object of the invention is to provide a lid opening mechanism which is of simple construction and ensures a secure mode of operation.

This object is achieved by the features of the independent claims. Further embodiments are specified in the subclaims which refer back to these.

According to the invention, a lid opening mechanism is provided in order to open a lid element at a first side about a first lid rotational axis or, optionally, at a second side about a second lid rotational axis, with the first rotational axis and the second rotational axis each formed by a front and a rear rotational axis element which are movable between a retracted and an extended position, having a first actuating device with a first actuating element and a second actuating device with a second actuating element which are respectively coupled mechanically to the front and the rear rotational axis element of the first rotational axis and the second rotational axis such that by actuating one of the actuating elements the front and the rear rotational axis element of the associated rotational axis are moved into corresponding guide means which are connected to the console such that the first rotational axis or the second rotational axis may act as a rotational axis in order to open the lid at the respectively opposite side, with the actuating means connected to a rotational axis control device with a control element and with actuating rods which cooperate with the actuating means to cooperate in such a way that when one of the actuating elements is actuated to activate the first or the second rotational axis a control element blocks the respectively other actuating element, with each actuating means having an actuating rod which couples each actuating element to the control element, and the control element being arranged between the actuating rods and having control faces which face the latter and in which, in the event of a movement by an actuating rod, the control element is pushed in relation to the other actuating rod into a position in which this other actuating rod cannot move the control element.

The lid actuating means can in this case include:

hinge strips, of which each is borne rotatably to rotate in the region of a first lid opening side by means of hinge strip axes at those ends of the hinge strips that are arranged in the region of the first longitudinal side on abutting sides, running transversely to the longitudinal sides, of the lid element, and have the bearing means for receiving the rotational axis elements so that the lid element can be pivoted open at the second longitudinal side when the first rotational axis element is retracted into the bearing means of the hinge strips and the second rotational axis elements are withdrawn from the bearing means and into a retracted position and reach partly into bearing means of the hinge strips, with the rotational axis elements at the second longitudinal side reaching, in an extended position, through the bearing means of the hinge strips and into bearing means in the console in order to create a rotary joint between the lid element and the hinge strips in the region of the second longitudinal side if at the same time the rotational axis elements of the first rotational axis are moved out of the bearing means of the hinge strips such that the lid element can be pivoted open at the first longitudinal side.

The hinge strips can be borne in opposition to the pretension of a spring at the front part and the rear part of the console.

The invention will be described below with reference to the attached figures, in which.

Figure 9:
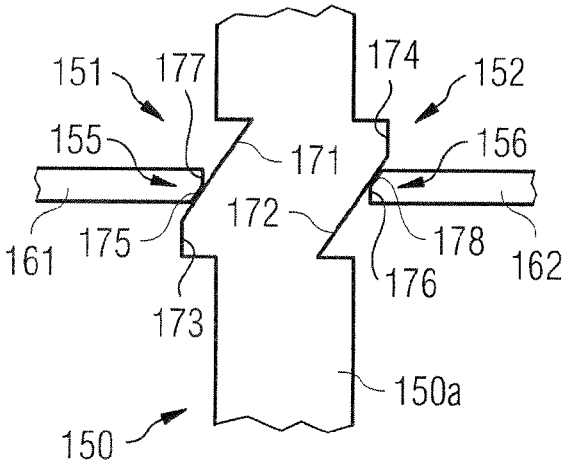
Figure 10:
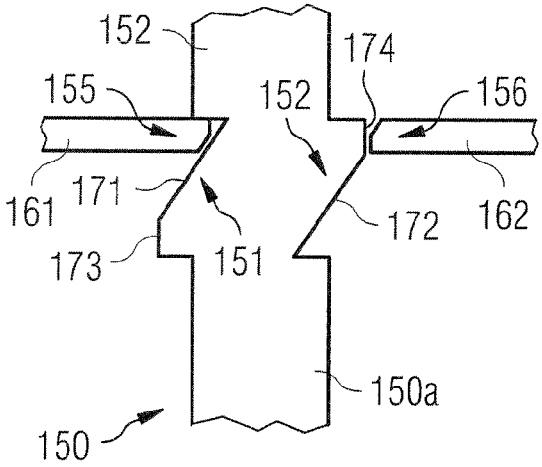
Figure 11:
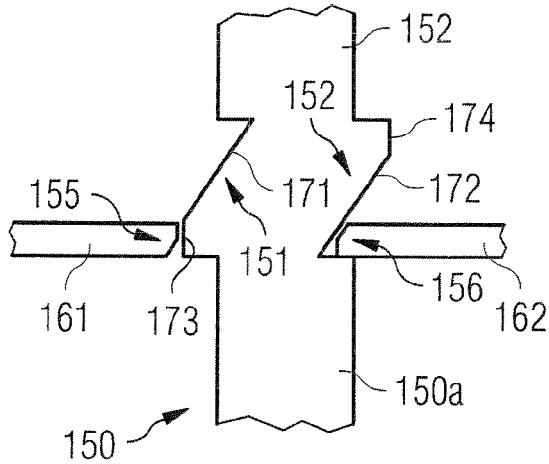
Figure 12:
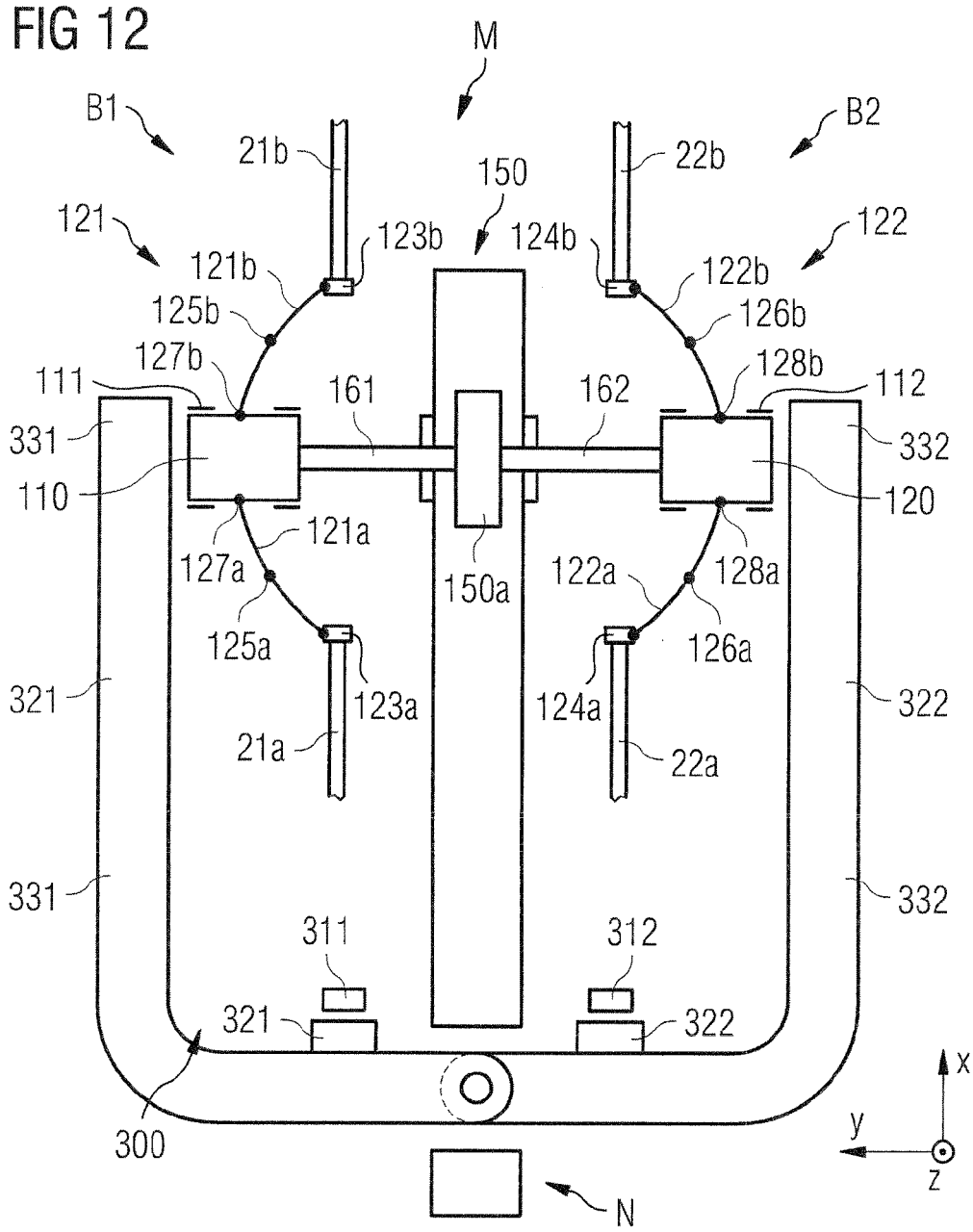
Figure 13:
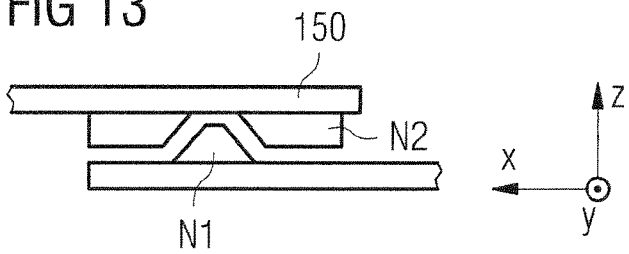

FIG. 9 shows a detail illustration of the rotational axis control device with a control slide and parts of the actuating rods in each case in a neutral position, FIG. 10 shows an illustration of the rotational axis control device in accordance with FIG. 9, in which a first actuating rod is in a released position and the second actuating rod is in a locked position, FIG. 11 shows an illustration of the rotational axis control device in accordance with FIG. 9, in which the second actuating rod is in a released position and the first actuating rod is in a locked position;

FIG. 12 shows a further development of the invention, in which the rotational axis control device and a locking means are shown, and FIG. 13 shows a detail of a cross section in the XZ plane of elements of the locking means which are illustrated in FIG. 12.

To describe the invention, reference will be made to a reference coordinate system having an X axis, a Y axis and a Z axis. Using the lid opening mechanism according to the invention, it is possible for a lid element or lid D, arranged on a console K, to be opened from a first side Y1 and a second side Y2, with the result that the lid D is pivoted open to the relevant side.

The X axis runs transversely in relation to these sides. When the lid opening mechanism A according to the invention is arranged on a storage compartment of a central console in a motor vehicle, the X axis preferably runs in the assumed direction of travel of the vehicle. In this case, Y1 may for example designate the driver's side and Y2 the passenger side.

The console K preferably has a storage compartment which is completely or partly covered by the lid D in its closed position. For the description which follows, a front part 1*a* and a rear part 1*b* of the console K, as seen in the X direction, are taken as the basic starting point, and the longitudinal sides 11, 12 of the lid D on the first side Y1 and second side Y2 thereof run between these.

Figure 6:
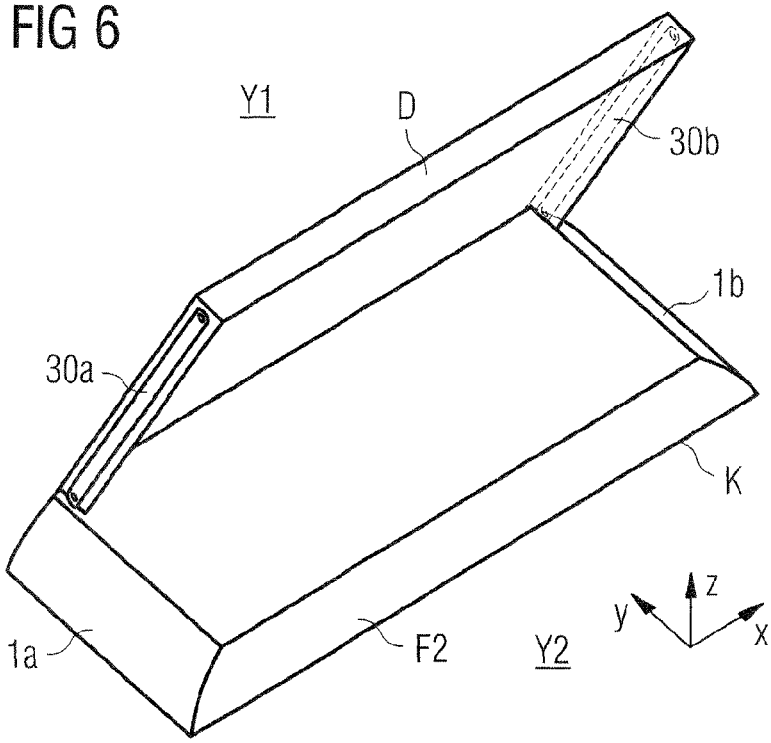
FIG. 6 shows a perspective illustration of the storage compartment with the lid element in an operational position, in the direction of view of FIG. 5, in which the lid element is opened to a first side.
Figure 7:
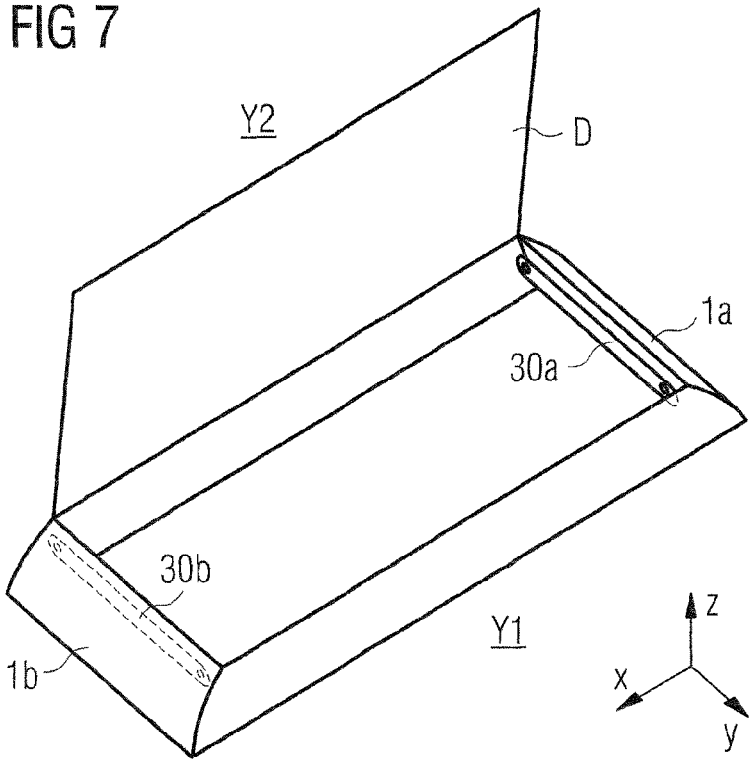
FIG. 7 shows a perspective illustration of the storage compartment with the lid element in an operational position from a direction of view which is in opposition to that in the illustration of FIG. 6, in which the lid element is opened to a second side.
Figure 8:
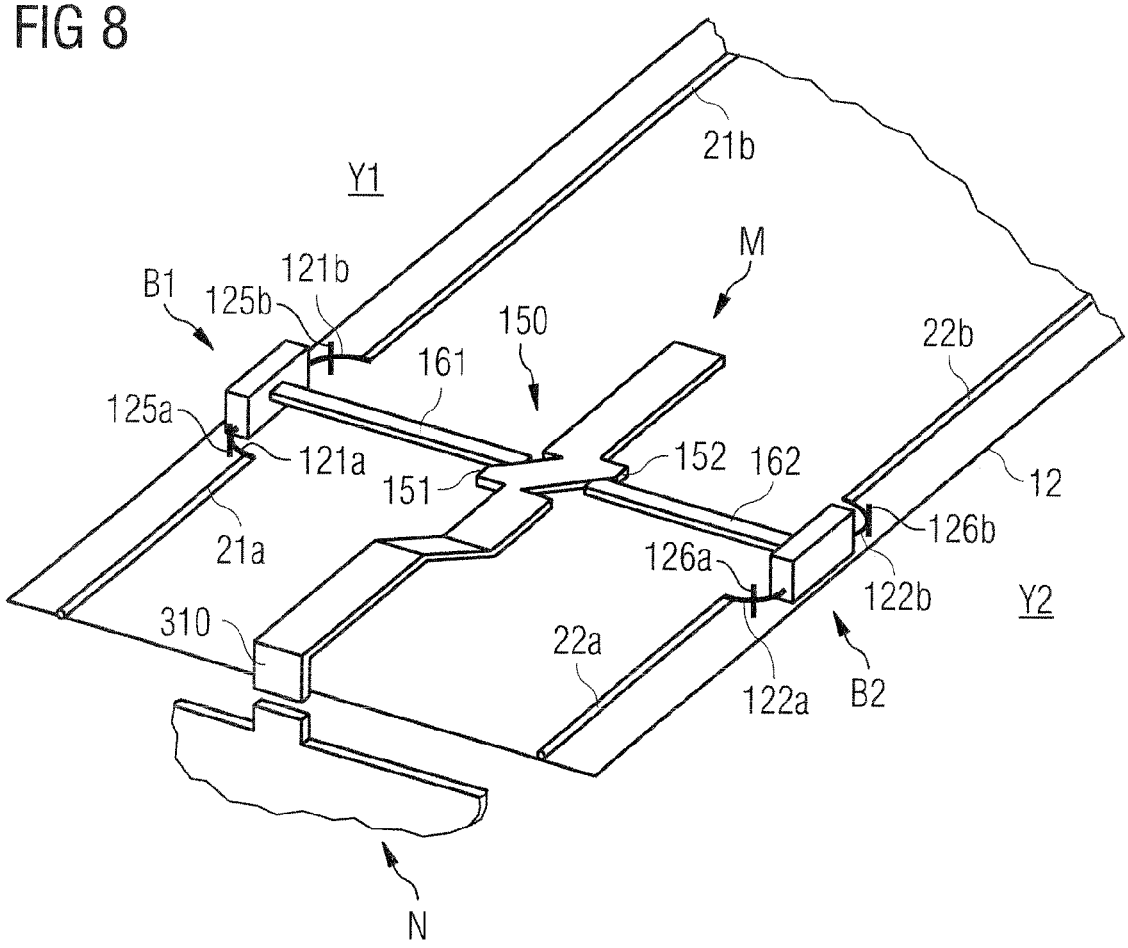
FIG. 8 shows a perspective illustration of the lid element with a rotational axis control device.

Opening of the lid element or the lid D at the first side Y1 (FIGS. 1 and 7) is performed by turning the lid D about a first lid rotational axis 21 which is located at a first lid longitudinal side or lid opening side 11. Similarly, opening of the lid D at the second side Y1, that opposite the first side Y1 (FIGS. 2 and 6) is performed by turning it about a second lid rotational axis 22 which is located at a second lid longitudinal side or lid opening side 12.

The first rotational axis 21 and the second rotational axis 22 are in each case formed by a front rotational axis element 21*a* and 22*a* and a rear rotational axis element 21*b* and 22*b* respectively, which are arranged to move preferably axially one behind the other, as seen in the longitudinal direction thereof, and in relation to one another. For this purpose, the first front and rear rotational axis elements 21*a* and 21*b* of the first rotational axis 21 are borne and guided by at least one guide means 23*a* and 23*b* respectively, arranged in the lid element D. Similarly, the second front and rear rotational axis elements 22*a* and 22*b* of the second rotational axis 22 are borne and guided by at least one guide means 24*a* and 24*b* respectively, arranged in the lid element D.

The lid opening mechanism A has a lid actuating means B, with a first actuating device B1 having a first actuating element 110 and a second actuating device B2 having a second actuating element 120. Preferably, the first actuating element 110 is located at the first side Y1 of the lid D and the second actuating element 120 is located at the second side Y1 of the lid D. The actuating elements 110, 120 may be positioned in particular in a manner determined by ergonomic perspectives. For example, the actuating elements 110, 120 may also be arranged centrally on the upper side of the lid D.

The first actuating device B1 is mechanically coupled to the front and rear rotational axis elements 21*a* and 21*b* of the first rotational axis 21 such that when the first actuating device B1 is actuated the front and rear rotational axis elements 21*a* and 21*b* are moved apart, into corresponding guide means connected to the storage compartment, with the result that the first rotational axis 21 can act as a rotational axis for opening the lid 1 at the opposite side Y2. Similarly, the second actuating device B2 is mechanically coupled to the front and rear rotational axis elements 22*a* and 22*b* of the second rotational axis 22 such that when the second actuating device B2 is actuated the front and rear rotational axis elements 22*a* and 22*b* are moved apart, into corresponding guide means connected to the storage compartment, with the result that the second rotational axis 22 can act as a rotational axis for opening the lid 1 at the opposite side Y1.

With the opening mechanism A according to the invention, movement of the respective pair of rotational axis elements of the first or second rotational axis 21 or 22 between the activated and the released positions is performed by way of lever means 121 and 122 respectively, which mechanically couple position of an actuating element 110, 20 to the position of the respectively associated rotational axis elements 21*a*, 21*b* and 22*a*, 22*b*. Consequently, an actuation of for example the first actuating device B1 may push apart the front and rear rotational axis elements 21*a* and 21*b* of the first rotational axis 21 in order to move the first rotational axis 21 into corresponding bearing means arranged outside the lid D, with the result that the first rotational axis 21 becomes an effective rotational axis and the lid D can be pivoted about this first rotational axis 21. A similar arrangement applies to the second actuating device and the second rotational axis 22.

This mechanical coupling may alternatively be achieved in another way. For example, the coupling between the actuating device B1, B2 and the rotational axis elements may also be performed by way of a different type of mechanism or an electrical drive.

The lid actuating means B cooperates with a rotational axis control device M having a control element 150 which is provided so that when one of the actuating elements 110 or 120 is actuated in order to activate the first or second rotational axis 21 or 22, the respectively other actuating element 120 or 110 is locked, with the result that the rotational axis elements associated therewith cannot be actuated therewith at the same time. For this purpose, the actuating devices B1, B2 are in functional connection with the control element 150 such that said locking action is exerted on the actuating element which is not actuated in each case.

According to the invention, the opening mechanism includes a rotational axis control device M having two actuating rods 161, 162 which are each in functional connection with the rotational axes 21, 22 by way of an actuating device B1 or B2 respectively, by way of which a corresponding selection by a user can push the respective rotational axis elements together or move them apart. The rotational axis control device M is located between the first and the second rotational axis 21 and 22 and between the first and the second actuating device B1 and B2, and has a control element 150. The control element 150 is shaped such that it can only be moved in a defined manner by that actuating rod 161, 162 which is activated or moved by means of a corresponding actuating device B1 or B2 associated therewith. The effect of the shaping of the control element 150 is that in the event of being moved by an actuating rod 161 or 162 the control element 150 is pushed in relation to the other actuating rod 162 or 161 into a position in which this other actuating rod 162 or 161 cannot move the control element 150.

A respective one of the transmission rods 161, 162 may be blocked by way of a control element 150 as soon as the respectively other transmission rod 161, 16 has been brought into the activated or released position by means of the actuating device B1 or B2 correspondingly associated therewith. This functionality of the rotational axis locking means M has the effect that the lid element 7 can optionally be opened only at one longitudinal side 11, 12 in mutually exclusive manner.

Figure 1:
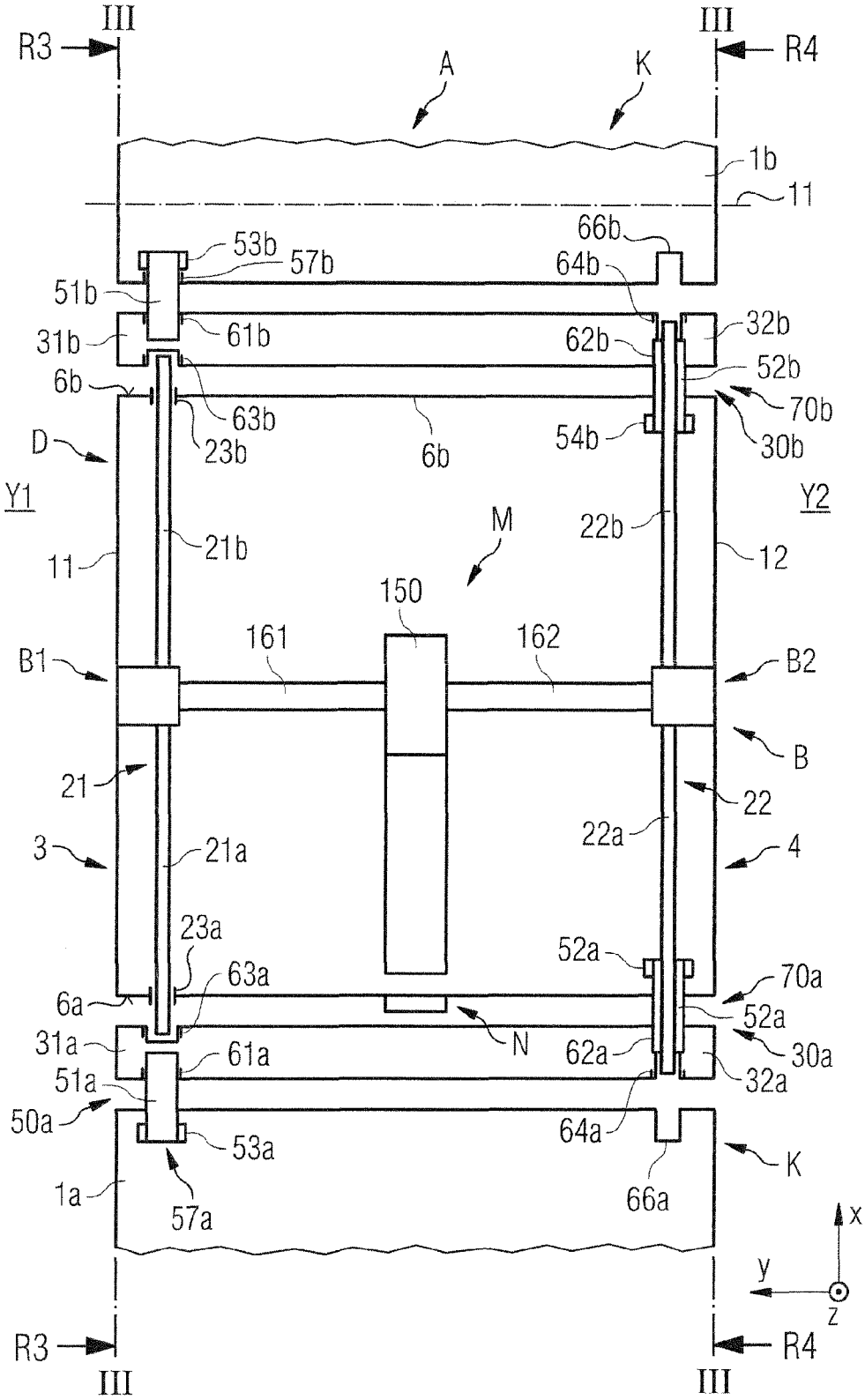
FIG. 1 shows a diagrammatic sectional illustration of the lid opening mechanism having a coordinate system, with a setting of the lid opening mechanism shown in which the lid element is capable of rotation about the negative X axis.
Figure 2:
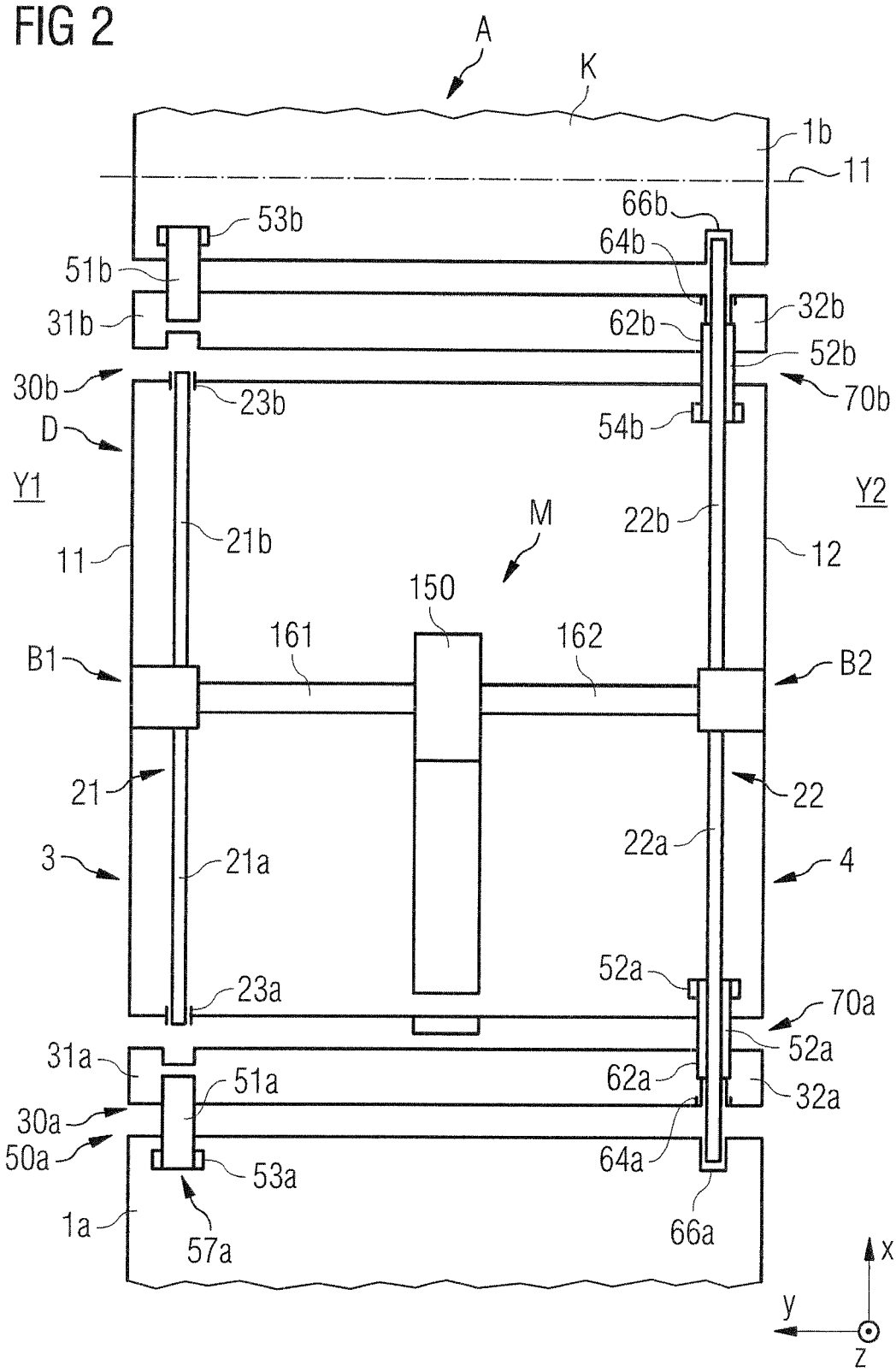
FIG. 2 shows the double hinge means in the illustration according to FIG. 1, a setting of the double hinge means being shown in which the lid element is capable of rotation about the positive X axis.
Figure 3:
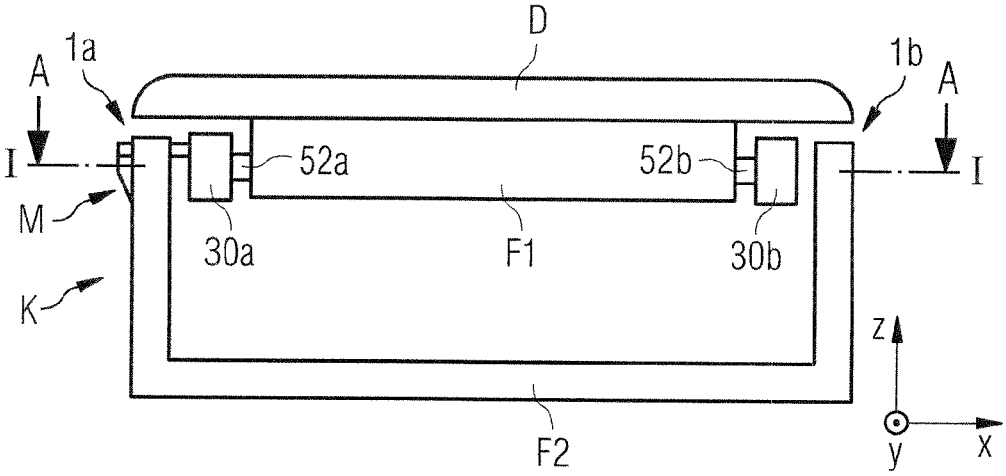
FIG. 3 shows a diagrammatic longitudinal section of the double hinge means along the plane III in FIG. 1, as seen in the direction of view R3.
Figure 4:
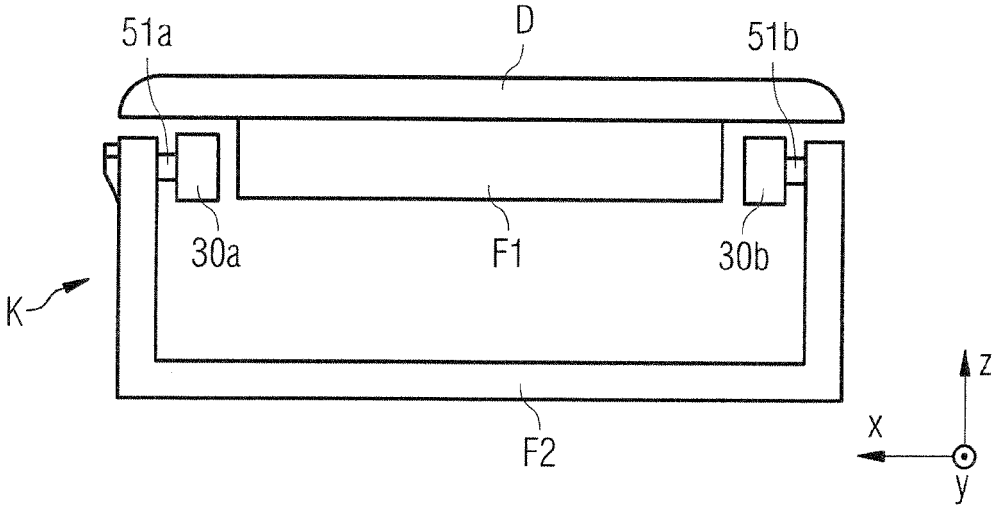
FIG. 4 shows a diagrammatic longitudinal section of the double hinge means along the plane IV in FIG. 1, as seen in the direction of view R4.

FIGS. 1 and 2 show the two settings by means of which the lid element D can be rotated on the one hand about the positive X axis and on the other about the negative X axis. Rotation about the negative X axis is performed about the first lid rotational axis 21 (FIG. 1) and rotation about the positive X axis is performed about the second lid rotational axis 22 (FIG. 2). On release of rotatability about the positive X axis (FIG. 2), rotation about the negative X axis is blocked by means of the control device M. Conversely, on release of rotatability about the negative X axis (FIG. 2), rotation about the positive X axis is blocked by means of the control device M.

The actuating device B1, B2 has the effect that on actuating the first actuating element B1 the first front and the first rear rotational axis elements 21*a* and 21*b* are moved apart and on actuating the second actuating element B2 the second front and the second rear rotational axis elements 22*a* and 22*b* are moved apart. In this embodiment, the effect of the control device M is that in a first function, when for example the first rotational axis elements 21*a*, 21*b* are moved together because the first actuating element B1 is actuated in the direction of actuation, the second actuating rod 162 is pressed in the direction of actuation by means of the control element 150 in order to lock the second actuating element in its starting position. This means that it is not possible to open the lid D at the second longitudinal side 12 at the same time.

The actuating element B1, B2 and the rotational axis control device M in functional cooperation therewith may be constructed in a different way if this fulfills the function described. The actuating element B1, B2 and the rotational axis control device M will be described below in the embodiment according to FIGS. 9 to 12.

The actuating elements 110, 120 of the actuating devices B1 and B2 are movable between two switch positions and for this purpose are guided to a guide or guide means 111, 112. Articulated to each switch element 110, 120 is on the one hand a lever 121*a*, 122*a* which acts on the front rotational axis elements 21*a* or 22*a* respectively by way of an abutting element 123*a*, 124*a*. On the other hand, articulated to each switch element 110, 120 is a lever 121*b*, 122*b* which acts on the rear rotational axis element 21*b*, 22*b* by way of another abutting element 123*b*, 124*b*. The guide 111 may alternatively be dispensed with completely or be replaced by an element of the same function, such as a lever. The essential point is that the switching travel predetermined between the switch positions is transmitted for example by way of the levers 121*a*, 121*b* and 122*a*, 122*b* to the rotational axis elements 21*a*, 21*b* and 22*a*, 22*b* such that the rotational axis elements 21*a*, 21*b* and 22*a*, 22*b* are moved from a first position or starting position of the switch element 110, in a mutually close or moved-together position, into a second position or open position in which the rotational axis elements 21*a*, 21*b* and 22*a*, 22*b* are in a moved-apart position. In the embodiment of the actuating devices B1, B2 according to FIG. 12, the levers 121*a*, 121*b* and 122*a*, 122*b* are borne in an articulation 125*a*, 125*b* and 126*a*, 126*b* respectively and are moreover connected in articulated manner at one end by way of an entrainer or articulation 127*a*, 127*b* and 128*a*, 128*b* respectively to the guide means 111, 112 or directly to the switch element 110.

The switch element 110 or 120 acts by way of an actuating rod 161 or 162 respectively on a control slide 150 having a first control face 151 for controlling the first actuating rod 161 and a second control face 152 for controlling the second actuating rod 162. The control faces 151, 152 are shaped such that in the event of a movement of the first switch element 110 into its second or pressed-in position, movement of the second switch element 112 is blocked and hence it is held in its starting position and vice versa, and that in the event of a movement of the second switch element 120 into its second or pressed-in position, movement of the first switch element 110 is blocked and hence it is held in its starting position.

Furthermore, the control faces are shaped such that, in the event of a movement of the first switch element 110 into its second position, the control slide 150 is pushed into a first position (FIG. 10) and, in the event of movement of the second switch element 120 into its second position, it is pushed into a second position (FIG. 11), that is to say in each case into limit positions.

Latching elements 165 and 166 respectively are arranged on the actuating rods 161, 162 or the control slide 150 and these latch into corresponding latching devices on the lid element D once the actuating rods 161, 162 have been moved into positions corresponding to the second positions of the actuating elements 110, 120 or the control slide 150 has been moved into its limit positions.

By means of a reset mechanism N, the actuating rods and the actuating elements are brought back into their starting position.

In a preferred embodiment, the control slide 150*a* or its control faces 151, 152 and the abutting faces 155, 156 of the actuating rods 161, 162, cooperating therewith, are formed in accordance with FIGS. 9 to 11. The control face facing the first or second actuating rod 161 or 162 respectively has a face 171 and 172 respectively which runs obliquely in relation to the longitudinal direction of the actuating rod 161 or 162 and a face 173 and 174 respectively running transversely in relation to this longitudinal direction, with which movement of the control slide 150*a* in relation to the actuating rod 161 or 162 is inhibited. The abutting faces 155, 156 of the first and second actuating rods 161 and 162 also preferably have a face 175 and 176 respectively which runs obliquely in relation to the longitudinal direction thereof and a face 177 and 178 respectively which runs transversely thereto, with the first-mentioned face 175 and 176 running parallel to the oblique control slide face 171 and 172 respectively and the last-mentioned face 177 and 178 running parallel to the transverse control slide face 173 and 174 respectively.

Each actuating rod 161, 162 is faced by a transverse face 173 or 174 respectively and an oblique face 171 or 172 respectively. The oblique faces 171 and 172 are arranged, as seen in the longitudinal direction of the slide 150*a*, on opposing sides of the control slide in certain regions. The transverse faces 173 and 174 of different sides of the control slide 150*a* are arranged offset from one another such that when an actuating rod 161, 162 abuts against a transverse face 173 or 174 respectively and the other actuating rod 162 or 161 abuts against an oblique face 172 or 171 and vice versa.

In the starting position, the oblique face 171 of the control face 151 and the oblique face 175 of the actuating rod abut against one another (FIG. 9). The face 177 of the actuating rod running transversely to the longitudinal direction of the actuating rod and the face 173 running transversely thereto of the control face 151 are arranged opposite one another in relation to the region, produced in this position, of mutually abutting oblique faces.

The orientation of the oblique faces and the mode of operation of the control slide 150 with the actuating rods 161, 162 is as follows: when an actuating rod 161 or 162 is actuated to arrive in a second position, the respective oblique faces 171, 175 and 172, 176 slide against one another, as a result of which the control slide 150 is moved transversely to the longitudinal direction of the actuating rods 161, 162. On the side opposite the actuation side, the respective transverse face 178 or 177 of the respectively non-actuated actuating rod 162 or 161 is moved towards the vertical face 174 or 173 of the control face 152, 151 respectively, until the vertical face 178 or 177 of the actuated actuating rod 162 or 161 finally comes into abutment with the vertical face 174 or 173 of the control face 152, 151 (FIGS. 10, 11). In this condition, the transverse faces on the side opposite the actuation side block movement of the actuating rod. Thus, in the event that the lid element D is opened at one side, the actuating element of the respectively other side can be blocked and cannot be actuated.

Preferably, furthermore, a reset mechanism N is provided. When one of the rotational axes 21, 22 is in its locked position and the respectively opposite rotational axis is in its released position, such that the lid element D can be opened at the longitudinal side located there, a reset mechanism N resets the rotational axis elements into their starting position. The reset mechanism N may be constructed in a different way, in accordance with the prior art.

The reset mechanism N may take the form of one or more spring means. In a preferred embodiment, the control slide 150 is pretensioned to two sides in an intermediate position, between the limit positions, by means of a spring means in such a way that the control slide 150 is moved automatically into its center position by means of the spring means as soon as latching elements (not shown) have been moved out of their latching devices when the lid D is closed by means of appropriate abutting faces. This is done by way of an unlocking device which acts on the control slide 150 accordingly when the lid, opened at one lid longitudinal side 11, 12, is closed and the corresponding lid longitudinal side 11, 12 comes into abutment with the respective console longitudinal side 1, 2.

FIGS. 12 and 13 illustrate diagrammatically a further possible embodiment of a reset mechanism N. The latter has a cam connected to the console K and a cam guide connected to the control element 150. The cam guide limits the position of the cam N1 in relation to the control element 150, which is displaceable longitudinally in relation to the cam. Here, the shape of the cam guide is constructed by means of appropriately shaped ramps such that the control element is pushed into a center position when the lid D is pivoted out of an open position and into the closed position. The mode of operation of closing the lid element D at its first lid longitudinal side 11 and at its second lid longitudinal side 12, and moving the rotational axis elements back into their starting position by means of the reset mechanism N is in this case as follows.

By actuating the second actuating element B2 to open the lid element D at its second lid longitudinal side 12, the second rotational axis elements 22*a*, 22*b* are moved out of the bearing means 66*a*, 66*b* in parts 1*a* and 1*b* of the console K, which abut against the lid element D, to release the second lid longitudinal side 12 opposite the abutting longitudinal side of the console. As a result of this, the first hinge strip axes 51*a*, 51*b* become rotational axes for opening the lid element D together with the hinge strips 30*a*, 30*b* at the first longitudinal side 11, with the ends of the first rotational axis elements 21*a*, 21*b* fixing the mobility between the lid element D at its first longitudinal side 11 and, lying close thereto, the ends 31*a*, 31*b* of the hinge elements 30*a*, 30*b* the lid element D transversely to the first rotational axis 21 (FIG. 1). Because, initially, the lid D can be opened and the rotational axis elements may be in a moved-together position, the reset mechanism N is provided and is used to retract the first rotational axis elements 21*a*, 21*b* into corresponding bearing means 63*a*, 63*b* in the ends 31*a*, 31*b* (which in the closed condition of the lid element D are located at the first rotational axis elements 21*a*, 21*b*) of the hinge elements 30*a*, 30*b*. A similar arrangement applies to the second first rotational axis elements 22*a*, 22*b*.

In the event that the dual compartment means has a lower container F2 on which there is arranged an upper container F1 which is pivotable by way of the pivoting mechanism 10, a lid locking and release device—or a lock 300 to prevent incorrect operation of the lid—is provided, and this is used to lock the opening mechanism A of the lid when the pivoting mechanism is released and vice versa. This lock 300 is used to block opening of the lid element D as soon as or as long as the upper compartment F1 is not in its starting position lying on the lower compartment F2, but is in an open position. For this purpose, a control lug 310 is arranged on the console K. This control lug 310 has two abutting elements 311, 312 which themselves cooperate with a respective abutting element 321, 322 of a locking lever means 320 when the lid element D is closed. The locking lever means 320 includes two levers 321, 322 which are connected to one another in articulated manner and form at their end the actuating switch 110 or 120 or are connected thereto. As a result of the cooperation between the abutting elements, the mobility of the levers 331, 332 and hence actuation of the actuating switches or the switch elements 110, 120 is blocked, with the result that it is not possible to open the lid element D.

To provide a way of opening the lid D from two sides Y1, Y2, the opening mechanism A may be constructed in the particular embodiment described below.

The capacity to open the lid D from two sides Y1, Y2 is produced in accordance with the invention by means of a front hinge strip 30*a* which is located at the front region 1*a* of the console K and a rear hinge strip 30*b* which is located at the rear region 1*b* of the console K. For the description below, the front and rear end sides of the lid element D, arranged in the front region 1*a* and the rear region 1*b*, are designated by the reference numerals 6*a* and 6*b*.

The lid actuating means B by means of which opening and locking of the lid element 7 is possible to two sides includes the two lid rotational axes 21 and 22 running along the lid opening sides 11, 12 and two front and rear hinge strips 30*a* and 30*b* which run transversely thereto along the front and rear abutting sides 6*a*, 6*b* of the lid element 5, both of these being borne rotatably on the same lid opening side or lid longitudinal side, that is to say either the first or the second lid opening side or lid longitudinal side 11 or 12. In the embodiment shown in FIGS. 1 to 7, the first ends 31*a*, 31*b* of the hinge strips 30*a* and 30*b* are located at the first lid opening side or longitudinal side 11 and are borne by means of a front and a rear hinge strip axis 51*a* and 51*b*, called axis elements below for short. In the description of the invention which follows, this arrangement is taken as a starting point.

The first ends 31*a*, 31*b* of the hinge strips 30*a* and 30*b* are respectively borne by means of a first bearing means 50*a* and 50*b*, on the one hand rotatably and preferably in opposition to a spring pretension on the front part 1*a* and the rear part 1*b* of the console K respectively, and on the other by means of the front and the rear rotational axis element 21*a* and 21*b* on the lid element D when the front and the rear rotational axis element (21*a* and 21*b* respectively) of the first rotational axis (21) are in the moved-apart position. Furthermore, the two ends 32*a*, 32*b* of the hinge strips 30*a* and 30*b* are respectively borne by means of a second bearing means 70*a* and 70*b*, on the one hand on the lid element D rotatably and preferably in opposition to a spring pretension, and on the other by means of the front and the rear rotational axis element 22*a* and 22*b* respectively on the front part 1*a* and rear part 1*b* of the console when the front and the rear rotational axis element (21*a* and 21*b* respectively) of the first rotational axis (21) are in the moved-apart position.

The first bearing means 50*a* and 50*b* respectively include the hinge strip axis or the axis element 51*a* and 51*b*, by means of which the respective hinge strip 30*a* and 30*b* is borne rotatably and preferably in opposition to a spring pretension on the front part 1*a* and the rear part 1*b* of the console 1.

In the embodiment in accordance with FIGS. 1 and 2, the spring pretension which is preferably provided takes the form of respectively a front spring element 53*a* and a rear spring element 53*b* or one of these spring elements, which is secured on the one hand to a securing means (not shown) on the front part 1*a* and the rear part 1*b* and on the other hand to the hinge strip axis 51*a* or 51*b* respectively when the transmission element is borne form-fittingly in the hinge strip 30*a*, 30*b*. Alternatively, the transmission element may be borne form-fittingly in the front and rear part and rotatably in the hinge strips, in which case the spring element is secured on the one hand to the transmission element and on the other to the hinge strip. The essential point for the various constructions is that the at least one spring element 53*a*, 53*b* acts between the hinge strips 30*a*, 30*b* and the respective part 1*a* or 1*b* of the upper compartment 5. The force of the spring tension preferably acts in the movement of opening the lid element D about the first rotational axis 21, that is to say the rotational force of the spring is turned in the positive X direction. As a result of this, it is possible to equalize the forces of the weight of the lid element 7 between friction forces of the pivot bearing and the spring force in a partly or completely open position, and the lid element 7 can be held stably in such a position.

In a preferred embodiment, the hinge strip axis 51*a* is borne rotatably in a bearing means 61*a* in the front part 1*a* and rotationally fixed in a bearing means 59*a* in the front hinge strip 30*a*. Similarly thereto, the hinge strip axis 51*b* is borne rotatably in a bearing means 57*b* in the rear part 1*b* and rotationally fixed in a bearing means 61*b* in the rear hinge strip 30*b*. The bearing means 61*a*, 61*b* are arranged on the side of the hinge strip 30*a* and 30*b* facing the front part 1*a* and the rear part 1*b* for the purpose of receiving the hinge strip axes 51*a* and 51*b* respectively. These bearing means 61*a*, 61*b* are preferably made rotationally fixed in that the bearing contours of the bearing means 61*a*, 61*b* cooperate form-fittingly with the corresponding cross sections of the hinge strip axes 51*a* and 51*b*. As an alternative to this embodiment, the hinge strip axis may be borne rotatably on the front part 1*a* and rear part 1*b* and by means of the bearing means 57*a* and 57*b*, and rotatably on the hinge strips 30*a* and 30*b* by means of the bearing means 61*a* and 61*b*, in which case the spring elements 53*a* and 53*b* are secured on the one hand to the hinge strip axes 51*a* and 51*b* respectively and on the other to a securing means (not shown) on the hinge strips 30*a* and 30*b*. In a further alternative, the rotatable and spring-pretensioned bearing of the hinge strip 30*a* and 30*b* may also be of a different construction.

Arranged on those sides of the first ends 31*a*, 32*a* of the hinge strips 30*a* and 30*b* which face the lid element D is a bearing means 63*a* and 63*b* respectively for bearing the longitudinally displaceable rotational axis elements 21*a* and 21*b*. The longitudinally displaceable rotational axis elements 21*a* and 21*b* are borne in the corresponding bearing means 63*a* or 63*b* once the rotational axis elements 21*a* and 21*b* have been brought into a moved-apart position by means of the actuating device B1.

The front and rear rotational axis elements 21*a*, 21*b* may be moved out of or into the respective bearing means 63*a* and 63*b* by the first actuating device B1. In the moved-apart condition, in which the rotational axis elements have been retracted into the respective bearing means 63*a* and 63*b*, the lid element D is fixed and rotatable on the first lid longitudinal side 11 transversely to the axial direction of the first rotational axis 21.

Optionally, the second bearing means 70*a* and 70*b* respectively includes a front and a rear guide element 52*a* and 52*b* by means of which the respective hinge strip 30*a* or 30*b* is borne rotatably and preferably in opposition to a spring pretension on that side of the lid element D which faces the respective hinge strip 30*a* or 30*b*. The guide element may also be dispensed with, since the rotational axis elements 22*a*, 22*b* of the second rotational axis 22 may still reach partly into the bearing means 64*a* and 64*b* or a corresponding bore in the hinge strips even in their moved-together position and hence form a corresponding axis.

In the embodiment in accordance with FIGS. 5*a* and 5*b*, the spring pretension which is preferably provided takes the form of respectively a front spring element 54*a* and a rear spring element 54*b*, which is secured on the one hand to a securing means (not shown) on the lid element D and on the other hand to the guide element 52*a* and 52*b* respectively. The essential point is that the at least one spring element 54*a*, 54*b* acts between the hinge strips 30*a*, 30*b* and the respective side of the lid element D. The force of the spring tension preferably acts in the movement of opening the lid element D about the second rotational axis 22, that is to say the rotational force of the spring is directed in the negative X direction so that when the lid element D is opened at the second longitudinal side 11 it is possible to achieve equalization of the forces of the weight of the lid element D between friction forces of the pivot bearing and the spring force in a partly or completely open position, and the lid element D can be held stably in such a position. The front guide element 52*a* can in this case be borne rotatably in a bearing means 58*a* in the lid element D and rotationally fixed in a bearing means 62*a* in the front hinge strip 30*a* or vice versa. Similarly thereto, the guide element 52*b* may be borne rotatably in a bearing means 58*b* in the lid element D and rotationally fixed in a bearing means 62*b* in the rear hinge strip 30*b*. The bearing means 62*a*, 62*b* are arranged on the side of the hinge strip 30*a* and 30*b* facing the lid element D for the purpose of receiving the guide elements 52*a* and 52*b* respectively. These bearing means 62*a*, 62*b* are preferably made rotationally fixed in that the external contours of the transmission elements 52*a* and 52*b* cooperate form-fittingly with the corresponding cross sections of the bearing elements 62*a*, 62*b* of the hinge strips. As an alternative to this embodiment, the guide element 52*a*, 52*b* may be borne by means of the bearing means 58*a* and 58*b* respectively in rotationally fixed manner on the corresponding side of the lid element D and by means of the bearing means 62*a* and 62*b* rotatably on the hinge strip 30*a* and 30*b*, in which case the spring elements 54*a* and 54*b* are secured on the one hand to the guide elements 52*a* and 52*b* respectively and on the other to a securing means (not shown) on the hinge strips 30*a* and 30*b*. In a further alternative, the rotatable spring-pretensioned bearing of the hinge strip 30*a* and 30*b* may also be of a different construction. In particular, the rotatable and sprung bearings of the front and rear hinge strips may also be of different constructions.

At the second ends 32*a*, 32*b* of the hinge strips 30*a* and 30*b* there are arranged a bearing means 64*a* and 64*b* respectively, preferably in the form of continuous bores for bearing the longitudinally displaceable rotational axis elements 21*a* and 21*b* respectively. Furthermore, bearing means 66*a*, 66*b* are arranged on that side of the front part 1*a* and the rear part 1*b* facing the respective hinge strip 30*a* and 30*b*. The bearing means 66*a*, 66*b* are located opposite the bearing means 64*a* and 64*b* when the lid element is in the closed position. When the rotational axis elements 22*a*, 22*b* have been moved into their position in which they are moved apart in relation to one another, as a result of a corresponding actuation of the second actuating means B2, they project through the bearing means 64*a* and 64*b* respectively, and the respective ends of the rotational axis elements 22*a*, 22*b* are received or borne by the corresponding bearing means 66*a*, 66*b*. In this moved-apart condition of the rotational axis elements 22*a*, 22, the lid element D is fixed to the second lid longitudinal side 12 transversely to the axial direction of the second rotational axis 22 and is borne rotatably on the hinge strips and hence also in relation to the front and rear parts 1*a* and 1*b* (FIG. 2). The front and rear rotational axis elements 22*a*, 22*b* may be moved out of or into the respective bearing means 66*a* and 66*b* by the second actuating device B2. Once the rotational axis elements 22*a*, 22*b* have been moved into their position in which they are moved together in relation to one another, as a result of corresponding actuation of the actuating means B2, they project partly through the bearing means 64*a* and 64*b* respectively, and the respective ends of the rotational axis elements 22*a*, 22*b* are not received by the corresponding bearing means 66*a*, 66*b* (FIG. 1). In this condition, therefore, the second ends 32*a*, 32*b* of the hinge strips 30*a* and 30*b* are fixed, transversely to the axial direction of the second rotational axis 22, to the second longitudinal side 11 of the lid element D by way of the rotational axis elements 22*a*, 22*b* but the second ends 32*a*, 32*b* of the hinge strips 30*a* and 30*b* are released, transversely to the axial direction of the second rotational axis 22, in relation to the front and rear parts 1*a* and 1*b* of the console K by way of the rotational axis elements 22*a*, 22*b*.

The lid element D, with a first lid longitudinal side 11 and a second lid longitudinal side 12 running on its opening sides, is therefore borne on a console or receiver B with a first and a second console longitudinal side 1 and 2 which are associated with the first and second lid longitudinal sides 11 and 12, by means of first rotational axis elements 21*a*, 21*b* and second rotational axis elements 22*a*, 22*b* which are arranged on the lid element D and are each capable of being moved apart and together in their longitudinal direction and run along the first and second lid longitudinal sides 11 and 12, hinge strips 30*a*, 30*b* which are arranged to rotate in the region of a first lid opening side 11 at corresponding regions 1*a*, 1*b* of the console K and have the bearing means 63*a*, 63*b* and 62*a*, 62*b* for receiving the rotational axis elements 21*a*, 21*b* and 22*a*, 22*b* respectively, hinge strip axes 51*a*, 51*b* for rotational bearing of those ends 31*a*, 31*b* of the hinge strips which are located in the region of the first longitudinal side 11, at the front and rear regions 1*a*, 1*b* of the console K in order to be able to pivot the lid element D open at the second longitudinal side 12 once the first rotational axis elements 21*a*, 21*b* have entered the bearing means 63*a*, 63*b* of the hinge strips and the second rotational axis elements have withdrawn from the bearing means 66*a*, 66*b*, with the rotational axis elements 22*a*, 22*b* on the second longitudinal side 12 reaching partly into bearing means 62*a*, 62*b* of the hinge strips in a retracted condition, in order to form a rotary joint between the lid element D and the hinge strips in the region of the second longitudinal side 12, if at the same time the rotational axis elements 21*a*, 21*b* of the first rotational axis 21 are moved out of the bearing means 63*a*, 63*b* of the hinge strips 30*a*, 30*b* so that the lid element D can be pivoted open at the first longitudinal side 11.

Figure 5:
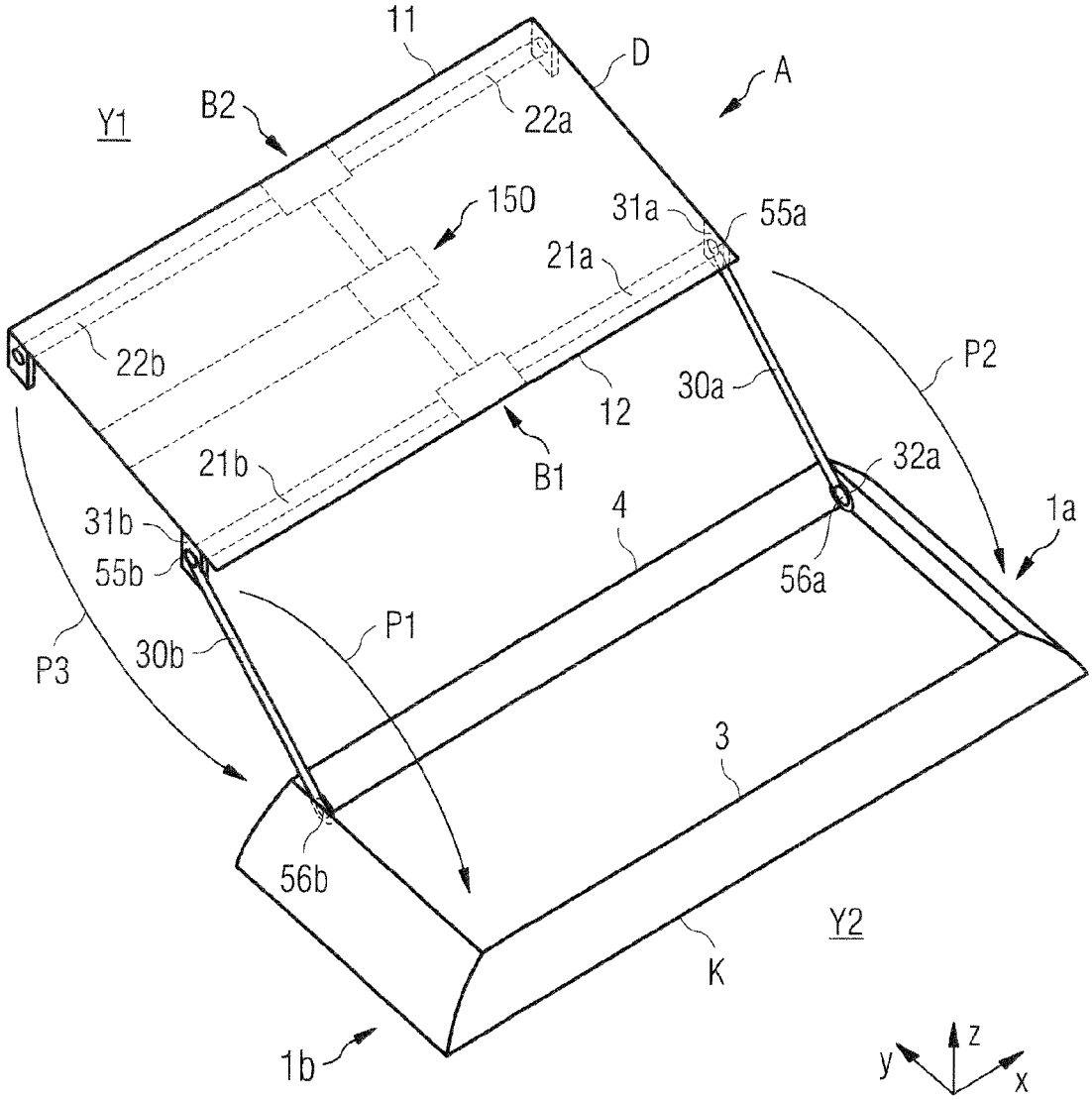
FIG. 5 shows a perspective illustration of the additional compartment with the lid element in an assembly position in which the lid element is shown connected by hinge strips to the storage compartment and raised away therefrom.

To illustrate the mode of operation of the lid opening mechanism A, FIG. 5 shows a general view, in a perspective illustration, of a console K in the form of a storage compartment F1 having the lid element D and the hinge strips 30*a*, 30*b* in a disassembled condition, in which the lid element D is shown connected to the console K or the compartment by way of the hinge strips and is raised away therefrom by this console or compartment, but in which the first and second support or longitudinal sides 3 and 4 of the compartment F1 have not been brought into abutment with the longitudinal sides 11, 12 of the lid element—as is provided in the operational position. Thus, when there is a move over from this assembly position into the operational position, the first and second support or longitudinal sides 3 and 4 of the console or receiver K are brought into abutment with the longitudinal sides 11 and 11 of the lid element in that the hinge strips are pivoted in accordance with the arrows P1, P2 and the lid element D is pivoted in accordance with the bearing PS.

The invention claimed is:

1. A lid opening mechanism comprising:

a lid;

a console, wherein the lid and the console each have first and second longitudinal sides and front and rear sides, respectively, the front and rear sides running transverse relative to the first and second longitudinal sides;

a first lid pivot spindle provided on the lid having a first front pivot-spindle element and a first rear pivot-spindle element, the first front and rear pivot-spindle elements each being movable between a retracted position and an extended position;

a second lid pivot spindle provided on the lid having a second front pivot-spindle element and a second rear pivot-spindle element, the second front and rear pivot-spindle elements each being movable between a retracted position and an extended position;

a first actuating element mechanically coupled to the first front and rear pivot-spindle elements;

a second actuating element mechanically coupled to the second front and rear pivot-spindle elements; and a control element, wherein the first and second actuating elements are each coupled to the control element by a first and a second actuating rod, respectively, the control element being arranged between the first and second actuating rods, wherein actuation of the first actuating element extends the first front and rear pivot-spindle elements for pivoting the lid about the first pivot spindle along the first longitudinal side, the second front and rear pivot-spindle elements being simultaneously retracted, wherein actuation of the second actuating element extends the second front pivot-spindle element and the second rear pivot-spindle element for pivoting the lid about the second pivot spindle on the second longitudinal side, the first front and rear pivot-spindle elements being simultaneously retracted, and wherein upon a movement of one of the first and second actuating rods, the control element is pushed relative to the other of the first and second actuating rods into a position in which the other of the first and second actuating rods cannot move the control element.

2. The lid opening mechanism according to claim 1, further comprising:

a front hinge strip having a first end and a second end; and a rear hinge strip having a first end and a second end, wherein the first end of each of the front and rear hinge strips is rotatably mounted to the front and rear sides of the console, respectively, in a region of one of the first longitudinal side and the second longitudinal side by front and rear first mounting devices, and the second end of each of the front and rear hinge strips is rotatably mounted to the front and rear sides of the lid, respectively, in a region of the other one of the first longitudinal side and the second longitudinal side by front and rear second mounting devices.

3. The lid opening mechanism according to claim 2, wherein actuation of the first actuating element extends the first front and rear pivot-spindle elements into corresponding first end front and rear hinge mounting devices provided at the first end of each of the front and rear hinge strips.

4. The lid opening mechanism according to claim 2, wherein actuation of the second actuating element extends the second front pivot-spindle element and the second rear pivot-spindle element through corresponding second end front and rear hinge mounting devices, respectively, provided at the second end of each of the front and rear hinge strips, and into corresponding front and rear console mounting devices, respectively.

5. The lid opening mechanism according to claim 2, wherein when the second front and rear pivot-spindle elements are retracted from the corresponding front and rear console mounting devices, the second front and rear pivot-spindle elements remain partially inserted in the second end front and rear hinge mounting devices.

6. The lid opening mechanism according to claim 2, wherein the front and rear hinge strips are borne in opposition to the pretension of a spring at the front and rear sides of the console.

* * * * *